United States Patent [19]

Huf

[11] 4,021,159

[45] May 3, 1977

[54] HOUSING FORMATION FOR A ROTARY PISTON MACHINE OR TROCHOIDAL CONSTRUCTION WITH AN OUTER ENVELOPE CURVE

[75] Inventor: Franz Huf, Constance, Germany

[73] Assignee: Dornier System GmbH, Germany

[22] Filed: Sept. 30, 1975

[21] Appl. No.: 618,253

[30] Foreign Application Priority Data

Dec. 19, 1974 Germany ..... 2460059

[52] U.S. Cl. ..... 418/61 B; 418/125; 418/150

[51] Int. Cl.[2] ..... F01C 1/02; F01C 21/10; F04C 17/02

[58] Field of Search ..... 418/61 A, 61 B, 150, 418/125, 129

[56] References Cited

UNITED STATES PATENTS 3,226,013 12/1965 Toyoda et al. ..... 418/61 B
3,764,239 10/1973 Huf ..... 418/61 A
3,936,248 2/1976 Fritzche et al. ..... 418/61 B

FOREIGN PATENTS OR APPLICATIONS 2,059,965 6/1972 Germany ..... 418/61 A

*Primary Examiner*—John J. Vrablik
*Attorney, Agent, or Firm*—James E. Bryan

[57] ABSTRACT

This invention relates to an improvement in a housing formation for a rotary piston machine of trochoidal construction with an outer envelope curve and a housing corresponding to said outer envelope curve, said piston being patterned after a turning point-free trochoid n:1, and working chambers between said housing and said piston separated by radial seals in said housing, the improvement comprising that the housing has the form of an outer parallel curve to the piston contour, whereby the equidistant distance of said parallel curve corresponds at least to the greatest deviation between said piston contour and the coordinated exact outer envelope curve.

2 Claims, 1 Drawing Figure

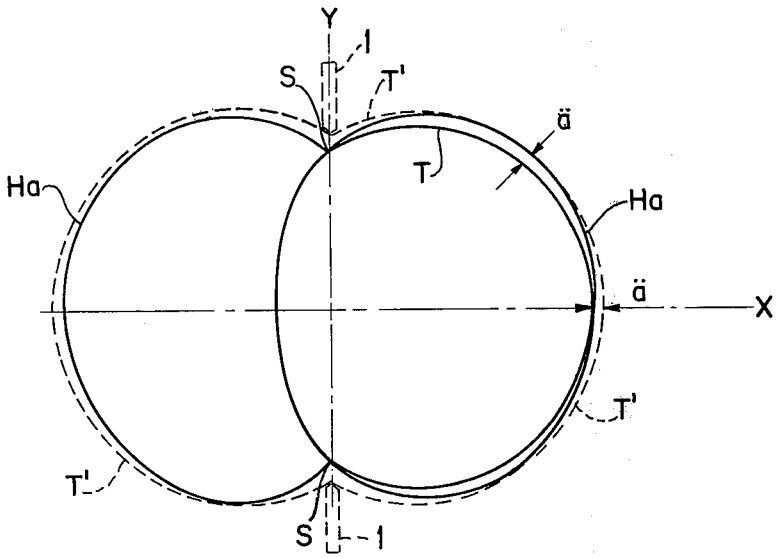
Y
1
S
T'
ä
T
Ha
Ha
ä
X
T'
T'
S
1

HOUSING FORMATION FOR A ROTARY PISTON MACHINE OR TROCHOIDAL CONSTRUCTION WITH AN OUTER ENVELOPE CURVE

The present invention relates to a housing formation for a rotary piston machine of trochoidal construction with an outer envelope curve in which the piston is patterned after a turning point-free epitrochoid or hypotrochoid *n*:1 and the housing corresponds to the outer envelope curve. The working chambers formed between the housing and the piston are separated from each other by radial seals 1 within the housing.

In such rotary piston machines, the rotating piston describes an outer envelope curve. This exact envelope curve coincides with the piston contour only at the so-called simultaneous points at which the radial sealing strips are positioned, and furthermore at the point of intersection with the axis of symmetry of the working chambers. At all other points, there arise more or less significant deviations between the piston contour and the envelope curve. This is true whether one considers the mathematically exact trochoid or a parallel curve to the trochoid, and in actual practice, the piston contours are generally parallel curves to the trochoid.

For producing such envelope curves for the housing formation of a rotary piston machine it is necessary to employ copying machines or specific processing devices which manufacture the aforementioned internal form by machining. The manufacturing processes by means of copying machines involve a very considerable expenditure with respect to manufacturing time and investment for the equipment. The use of specific processing devices requires the superposition of three different rotary movements in order to represent the envelope curve. The factor of economy, however, is of very special importance for the mass production of housings for the aforementioned rotary piston machines.

It is the object of the present invention to manufacture an internal housing form in a simple manner, while avoiding the aforementioned economic disadvantages and the disadvantages pertaining to manufacturing techniques.

This object is obtained, in accordance with the present invention, by virtue of the fact that the inner wall of the housing is formed by an outer parallel curve to the piston contour, whereby the equidistant distance of the parallel curve corresponds at least to the greatest deviation between the piston contour and the coordinated exact outer envelope curve. Such an internal housing form or shape may be made with the same grinding device as the piston itself, inasmuch as the piston contour and the housing form or shape are distinguished from each other only by the parallel curve distance. It is possible, of course, to produce in this manner approximation curves for the internal housing wall, whether a mathematically exact trochoid is used as a basis, or a parallel curve to the trochoid with a desired equidistant distance.

One embodiment of the present invention now will be described with reference to the accompanying drawing which shows one embodiment of the present invention. For greater clarity, a mathematically exact epitrochoid 1:1 is shown therein. The ratio of the sum radius R to the eccentricity E has been assumed to be R:E > 4 for reasons of the turning point freedom since the mathematical condition for turning point-free trochoids is for the eccentricity:

$$E = R/(n \pm 1)^2$$

wherein R is the sum radius for epitrochoids, and the differential radius for hypotrochoids, while the minus sign must be placed in the denominator for hypotrochoids; *n* is in each case the ratio of the base circle radius to the rolling circle radius of the first generating method. This trochoid is designated with T. The outer envelope curve formed during the rotation of the trochoid is identified with Ha. As is apparent from the figure, the trochoid T and the envelope curve Ha coincide, for the case shown, in only three points, and specifically at the two simultaneous points S during the intersection with the Y axis and during the intersection with the X axis. The X axis simultaneously represents the axis of symmetry of the working chamber. These same conditions or ratios also apply for the working chamber shown at the left.

As the FIGURE shows in the right hand portion thereof, sickle-shaped distance differences exit between the trochoid T and the envelope curve Ha. The maximum distance has been designated with $\ddot{a}$. A good approximation to the outer envelope curve Ha is achieved by a parallel cure T′ to the trochoid T in the distance $\ddot{a}$. This parallel curve is indicated in phantom in the FIGURE.

In the drawing itself, these conditions or ratios have been shown in a slightly exaggerated manner. The deviations between the envelope curve Ha and the parallel curve T′ to the trochoid produce three sickle-shaped surfaces, one of which extends in proximity to the X axis while the two others adjoin the Y axis in each case. In reality the surfaces and chambers shown between the envelope curve Ha and the parallel curve T′ are smaller than represented here. Thus they represent only an insignificant enlargement of the undesired space or chamber of a rotary piston engine built accordingly.

The present invention may be employed particularly advantageously when the ratio R:E > 5, since with a progressively increasing R:E, the difference between the envelope curve Ha and the parallel curve T′ becomes progressively smaller. Hence, also the approximation of the internal housing wall, being a parallel curve, to the exact envelope curve will progressively improve.

What is shown in the embodiment of a mathematically exact epitrochoid 1:1 and the mathematically exact outer envelope curve thereof is valid, of course, also for parallel curves to the trochoid. Only the basic concept has been illustrated in the embodiment described. The running clearance necessary between the piston and the internal housing wall has not been considered therein, but it may be introduced without difficulty depending upon requirements. As set forth at the outset, the present invention also may be employed for higher epitrochoids, for example the epitrochoid 2:1 , and also for hypotrochoids.

It will be obvious to those skilled in the art that many modifications may be made within the scope of the present invention without departing from the spirit thereof, and the invention includes all such modifications.

What is claimed is:

1. In a housing formation for a rotary piston machine of trochoidal construction with an outer envelope curve and a housing corresponding to said outer envelope curve, said piston being patterned after a turning point-free trochoid $n : 1$, and working chambers between said housing and said piston separated by radial seals in said housing, the improvement comprising that the housing has the form of an outer parallel curve to the piston contour when said piston is in its upper dead center position, the equidistant distance of said parallel curve being at least such that said parallel curve will twice touch from the outside the associated exact outer envelope between two consecutive radial seals.

2. A housing formation according to claim 1 in which said piston contour corresponds to an inner parallel curve to the mathematically exact trochoid.

* * * * *